US005884910A

United States Patent [19]

Mandel

[11] Patent Number: 5,884,910

[45] Date of Patent: Mar. 23, 1999

[54] EVENLY RETRACTABLE AND SELF-LEVELING NIPS SHEETS EJECTION SYSTEM

[75] Inventor: Barry P. Mandel, Fairport, N.Y.

[73] Assignee: Xerox Corporation, Stamford, Conn.

[21] Appl. No.: 912,804

[22] Filed: Aug. 18, 1997

[51] Int. Cl.[6] ..... B65H 29/20

[52] U.S. Cl. ..... 271/296; 271/274; 270/58.11

[58] Field of Search ..... 270/52.03, 58.11, 270/58.18, 58.28; 271/292, 294, 296, 303, 305, 273, 244

[56] References Cited

U.S. PATENT DOCUMENTS

| | | | |
|---|---|---|---|
| 4,775,140 | 10/1988 | Foster | 271/274 |
| 5,016,868 | 5/1991 | Ohtsuka et al. | 271/273 |
| 5,222,730 | 6/1993 | Miyake | 271/296 |
| 5,346,203 | 9/1994 | Stemmle | 271/296 |
| 5,544,874 | 8/1996 | DeFigueiredo | 271/302 |
| 5,639,078 | 6/1997 | Mandel et al. | 270/58.12 |
| 5,704,609 | 1/1998 | Mandel et al. | 271/303 |

FOREIGN PATENT DOCUMENTS

| | | | |
|---|---|---|---|
| 57-166246 | 10/1982 | Japan | 271/273 |
| 3-162344 | 7/1991 | Japan | 271/273 |
| 5-246595 | 9/1993 | Japan | 271/273 |

OTHER PUBLICATIONS

Patent Application 08/826,175 (D/97001) filed Mar. 1997, Title: Automatically Retractable Extending Nip Sheet Ejection System For a Multiple Output Locations Stacking Device, by Mandel, et al.

*Primary Examiner*—H. Grant Skaggs
*Assistant Examiner*—Patrick Mackey

[57] ABSTRACT

In a sheet handling system with a supporting frame, a sheets compiling tray, and a sheets ejection system including an drive shaft with plural sheet drive rollers and a pivotal mounting system for pivoting the drive shaft between a first position for sheets ejection and a raised second position, the pivotal mounting system provides vertical freedom of movement of at least one end of the shaft in the first position to provide a self-leveling more uniform sheet engagement force, yet also provides a positive accurately centered constrained position of the shaft in the second position. The illustrated pivotal mounting system includes a pivot pin vertically movable within a mounting slot in the supporting frame in the first position and spaced apart limited length mounting slots providing end stops engaging mounting pins in the second position to automatically center the pivot pin.

7 Claims, 5 Drawing Sheets

Figure 1:
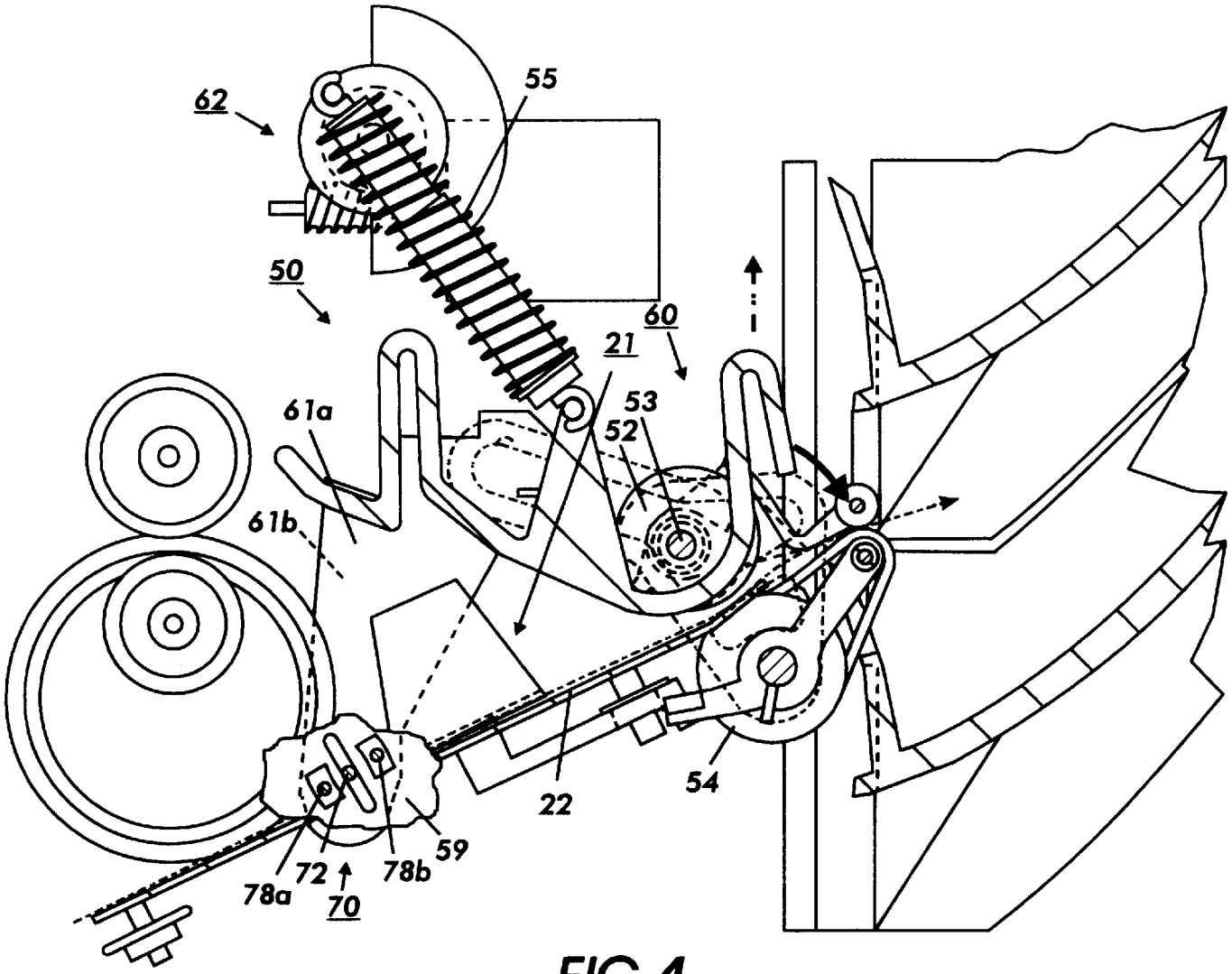

CONTROLLER
100
104
DISPLAY
102
10
11
11a
11b
18
26
17
25
14
23
22
18
60
13
21
25
26
22
70
17
16

EVENLY RETRACTABLE AND SELF-LEVELING NIPS SHEETS EJECTION SYSTEM

The present system provides improved reliability in sheet output feeding from a sheet compiler for a reproduction apparatus, especially for use in the stacking of sheets into selectable multiple output stacking locations, such as the feeding of various printed sheets into selected ones of the multiple bins or mailboxes of a printer mailboxing unit.

In particular, there is disclosed herein an improved simple and low cost intermittent sheets ejection system, with a self-leveling or floating nip system, for improved sheets feeding when engaged, yet positive control over drive shaft position when pivoting the sheet feeding system unobstructedly out of the sheet compiling area.

The feeding control of flimsy printed sheets, especially stacks of such sheets as they are being ejected into stacking bins, trays or mailboxes, presents long-standing problems, for which many different solutions have been attempted or proposed. The extensive discussions of these and other sheet handling problems in patents and other literature are known to those skilled in the art and need not be reiterated here.

Further by way of background, exemplary details of the exemplary illustrated embodiment of one compiling and sheet feeding ejection system for mailbox systems are disclosed, for example, in pending Xerox Corporation U.S. application Ser. No. 08/826,175 filed Mar. 27, 1997 by the same Barry P. Mandel and others, Attorney Docket No. D/97001, entitled "Automatically Retractable Extending Nip Sheet Ejection System for a multiple Output Locations Stacking Device". Further by way of background and as examples of compiling and sheet feeding ejection systems especially suitable for loading mailbox bins, there is disclosed Xerox Corporation U.S. Pat. No. 5,639,078 issued Jun. 17, 1997, filed Dec. 1, 1995 by the same Barry P. Mandel and others, Attorney Docket No. D/95206; and U.S. Pat. No. 5,513,839 issued May 7, 1996 to Frederick A. Green entitled "Dual Mode Sheet Stacking Tamper and Sheet Feeder Offset System" (D/94126). These and other patents cited herein may be referred to in connection with the following embodiment description for further details of exemplary sheet compiling, sheets ejection and mailbox systems.

Although the present system can also be applicable to various finishers and the like, the specific embodiment herein is shown in a printer "mailbox" system. By way of further background and further details of exemplary mailbox systems and their particular features and difficulties, there is noted the extensive discussion thereof, and the citation of other references in, Xerox Corporation U.S. Pat. No. 5,342,034 issued Aug. 30, 1994 to the same Barry P. Mandel and Richard A. VanDongen; and also U.S. Pat. No. 5,603,492 issued Feb. 18, 1997 and U.S. Pat. No. 5,382,012 issued Jan. 17, 1995 and U.S. Pat. No. 5,382,012 issued Jan. 17, 1995, to the same Barry P. Mandel and others. Note, e.g., that FIG. 1 of said U.S. Pat. No. 5,382,012 is similar to FIG. 5 herein. Similar disclosures are in other Xerox Corporation mailbox systems patents.

As explained in these mailboxing systems patents, by way of background, a mailboxing system is normally intended for separating plural page collated print jobs by users or clients into respective bins for the respective users, not for the collation of a print job by separating identical individual pages into different bins. Thus, in a mailboxing system, unlike a sorter or collator, the number of sheets to be compiled and placed in any one mailbox bin of the array of bins or mailboxes at any one time may vary greatly. Plural precollated sets of stapled or unstapled sheets may be placed in individual bins at one time. Also, the mailbox bins are not normally filled sequentially. This is in contrast to a sorter or collator system for post-collation of the plural pages of plural sets of a print job, normally by placing one identical copy sheet of each page of the job set sequentially in each bin one at a time until one identical job set is collated in each bin.

Another difference is that with moving bins sorters or collators, the bin spacing can be temporarily increased for the bin into which the sheets are being inserted, as is well known. However, mailbox bins are preferably fixed, and thus cannot. Yet, mailbox bins must be relatively closely superposed to provide enough bins for the various users or clients. That is, for a mailbox system which is relatively compact, yet still provides a sufficient number of mailboxes for a sufficient number of different shared users, the sheet capacity or sheet stacking height of each mailbox bin must be relatively limited, and the spacing between each mailbox bin must be relatively limited. This provides a practical restriction on the amount of space available between bins for the ejection of the sheets or sets of sheets into a respective bin, thus imposing further criticality on better control of the sheet ejection path into the bin to avoid misfeeding or jams.

A specific feature of the specific embodiment disclosed herein is to provide a sheet handling system including a supporting frame, a sheets compiling tray and a sheets ejection system, said sheets ejection system including an axial drive shaft with plural sheet drive rollers and a pivotal mounting system to which said drive shaft is mounted, said pivotal mounting system providing pivoting of said drive shaft with said plural sheet drive rollers between a first position for engaging sheets in said sheets compiling tray for sheets ejection and a second position out of engagement with said sheets in said sheets compiling tray; the improvement wherein said pivotal mounting system provides a limited degree of freedom of movement of at least one end of said axial drive shaft on an axis of movement perpendicular to said axial drive shaft when said pivotal mounting system has pivoted said drive shaft into said first position for engaging sheets in said sheets compiling tray for sheets ejection, to provide a self-leveling more uniform sheet engagement force of said plural sheet drive rollers along said drive shaft, said pivotal mounting system further providing a positive constrained engagement of said drive shaft by said pivotal mounting system when said pivotal mounting system is pivoting said drive shaft into said second position to provide a more accurately centered position of said shaft by said pivotal mounting system in said second position.

Further specific features disclosed herein, individually or in combination, include those wherein at least one side of said pivotal mounting system is pivotally mounted to said supporting frame with a pivot pin, and said supporting frame has a mounting slot for mounting and laterally constraining said pivot pin in said mounting slot but providing for vertical movement of said pivot pin therein to allow said one side of said pivotal mounting system to move vertically relative to said supporting frame, and wherein said supporting frame also has at least one limited length slot providing an end stop, which limited length slot is spaced from said mounting slot, and wherein said pivotal mounting system has at least one mounting pin engaged within said limited length slot, which mounting pin is vertically movable within said limited length slot in said first position of said pivotal mounting system, but which mounting pin engages said end stop of said limited length slot in said second position of said pivotal mounting system to constrain the position of said pivot pin in said mounting slot to insure an accurately centered position of said drive shaft by said pivotal mounting system in said second position; and/or wherein said pivotal mounting system includes a single lifting system engaging said drive shaft to lift said drive shaft into said second position which is dependent on said pivotal mounting system to maintain both ends of said drive shaft in a defined position in said second position; and/or further including a normal force spring centrally engaging said drive shaft in said first position; and/or further including plural fixed axis idler rollers mounted to oppose said plural sheet drive rollers when said drive shaft is in said first position; and/or wherein said drive shaft is rotatably mounted with a fixed position axis of rotation relative to said pivotal mounting system; and/or wherein said wherein said supporting frame has at a second limited length slot providing a second end stop, which limited length slot is spaced from the opposite side of said mounting slot, and wherein said pivotal mounting system has at a second mounting pin engaged within said second limited length slot, which second mounting pin is vertically movable within said second limited length slot in said first position of said pivotal mounting system, but which second mounting pin engages said second end stop of said second limited length slot in said second position of said pivotal mounting system to center the position of said pivot pin in said mounting slot to insure an accurately centered position of said drive shaft by said pivotal mounting system in said second position; and/or wherein said pivotal mounting system comprises a pair of pivotal mounting arms pivotally mounted on opposite sides of said sheets compiling tray for mounting opposite ends of said drive shaft; and/or wherein one of said pivotal mounting arms is mounted to said supporting frame with a fixed axis of rotation, and the other of said mounting arms is mounted to said supporting frame about an axis of rotation which is variable in said first position and fixed in said second position.

In general, in various reproduction apparatus such as xerographic and other copiers and printers or multifunction machines, it has become increasingly important to provide faster yet more reliable and more automatic and positive handling of the physical image bearing sheets, with better sheet control and reduced misfeeding, jam, and sheet damage rates. It is desirable to reliably feed and accurately register and stack sheets of a variety and/or mixture of sizes, types, weights, materials, humidity and other conditions, and susceptibility to damage. Sheets can vary considerably even if they are all of the same "standard" size, (e.g. letter size, legal size, A-4, B-4, etc.). They may have come from different paper batches or have variably changed size with different age or humidity conditions, different imaging, fusing, etc.

The disclosed system may be operated and controlled by appropriate operation of conventional control systems. It is well known and preferable to program and execute printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, of course, the control system or method may be implemented partially or fully in hardware, using standard logic circuits or single chip VLSI designs.

It is well known that the control of sheet handling systems may be accomplished by conventionally actuating them with signals from a microprocessor controller directly or indirectly in response to simple programmed commands, and/or from selected actuation or non-actuation of conventional switch inputs. The resultant controller signals may conventionally actuate various conventional electrical solenoid or cam-controlled sheet deflector fingers, motors or clutches, or other components, in programmed steps or sequences. Conventional sheet path sensors or switches connected to the controller may be utilized for sensing, counting, and timing the positions of sheets in the sheet paths, and thereby also controlling the operation of sheet feeders, etc., as is well known in the art.

In the description herein the term "sheet" or "copy" refers to a usually flimsy physical sheet of paper, plastic, or other suitable physical substrate for images, whether precut or initially web fed.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, all of which are incorporated by reference herein where appropriate for appropriate teachings of additional or alternative details, features, and/or technical background. What is well known to those skilled in the art need not be described here.

Figure 2A:
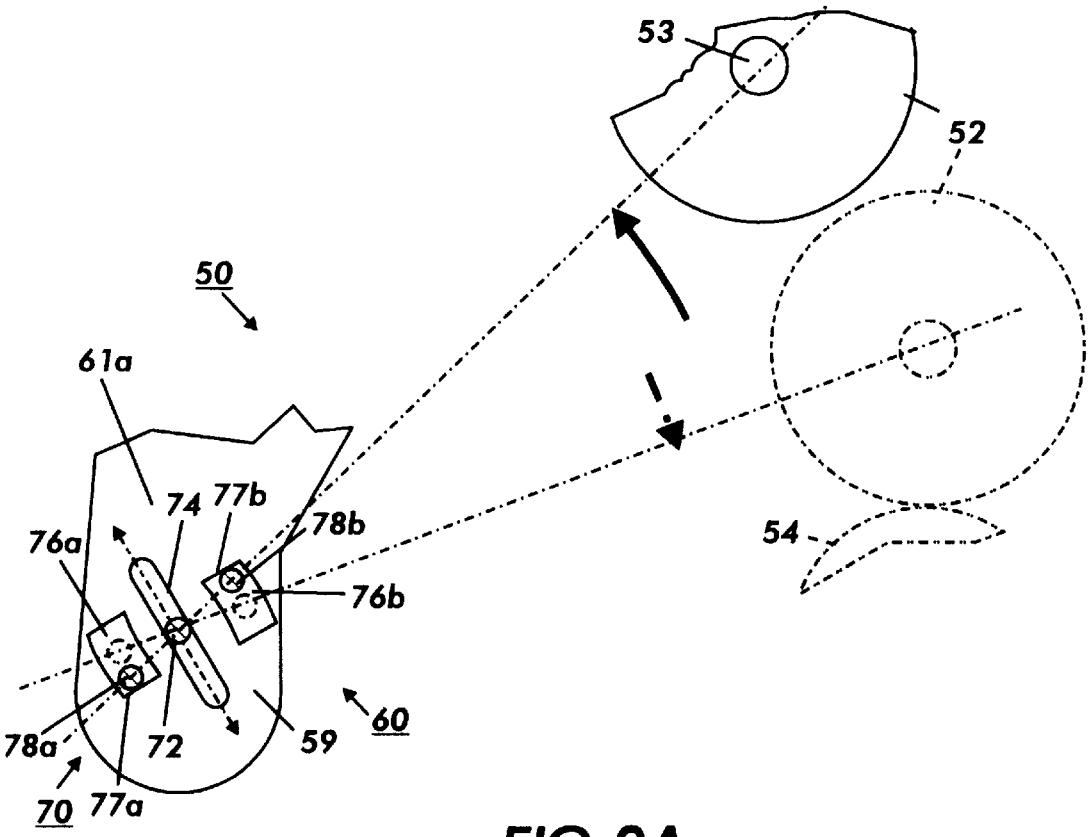
Figure 2B:
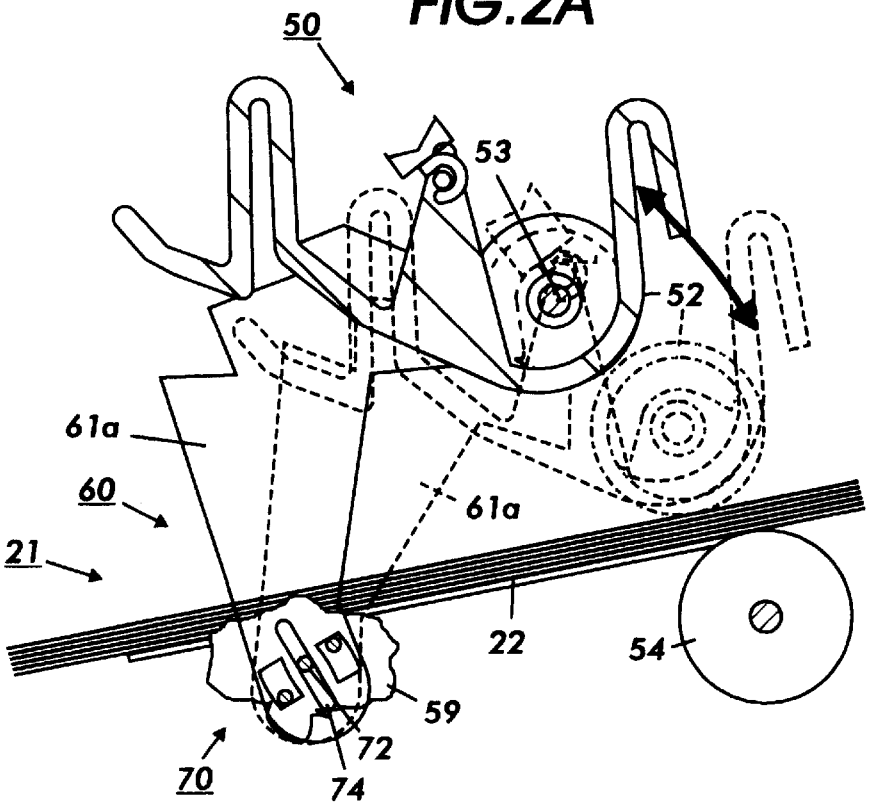
Figure 3:
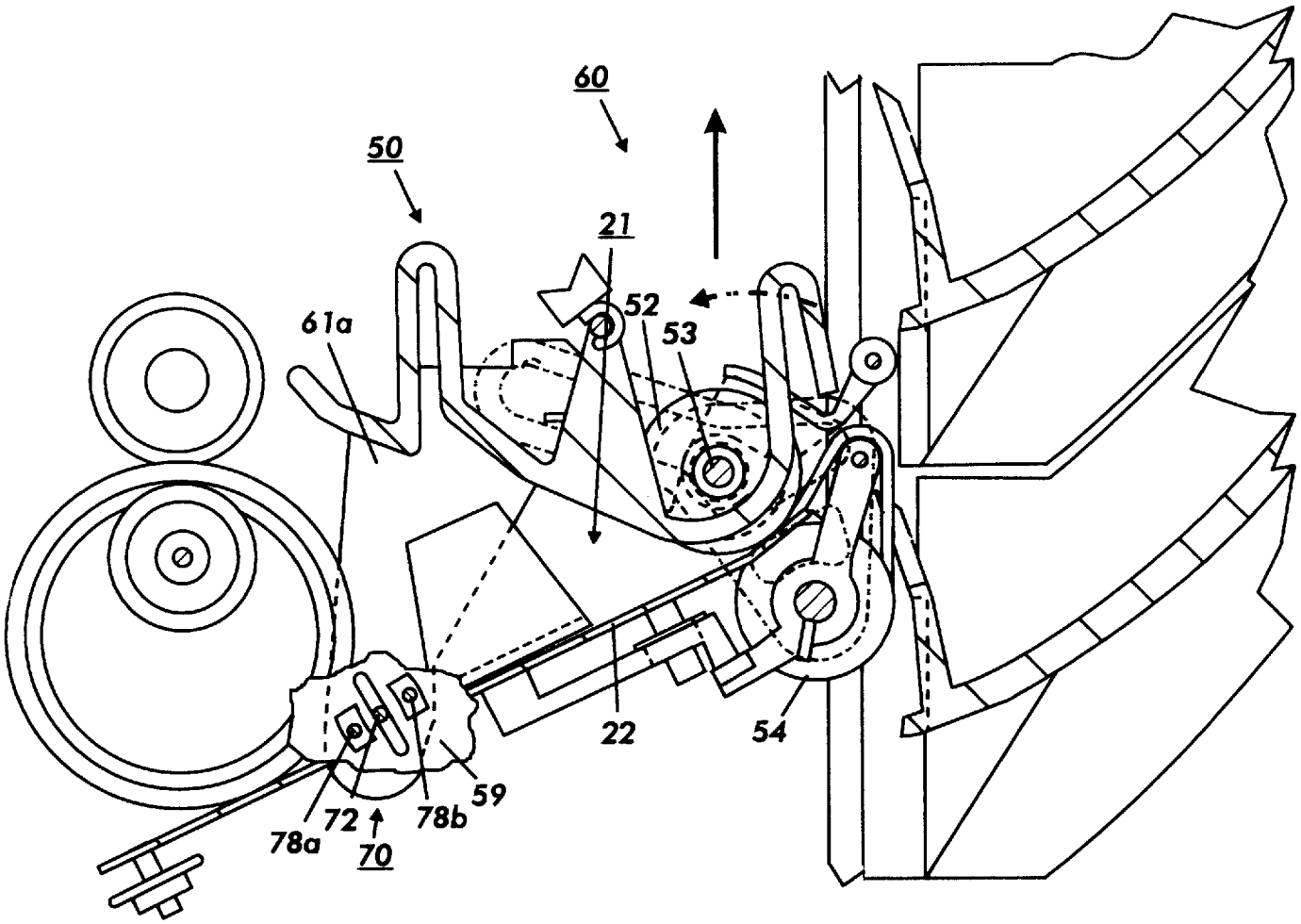
Figure 4:
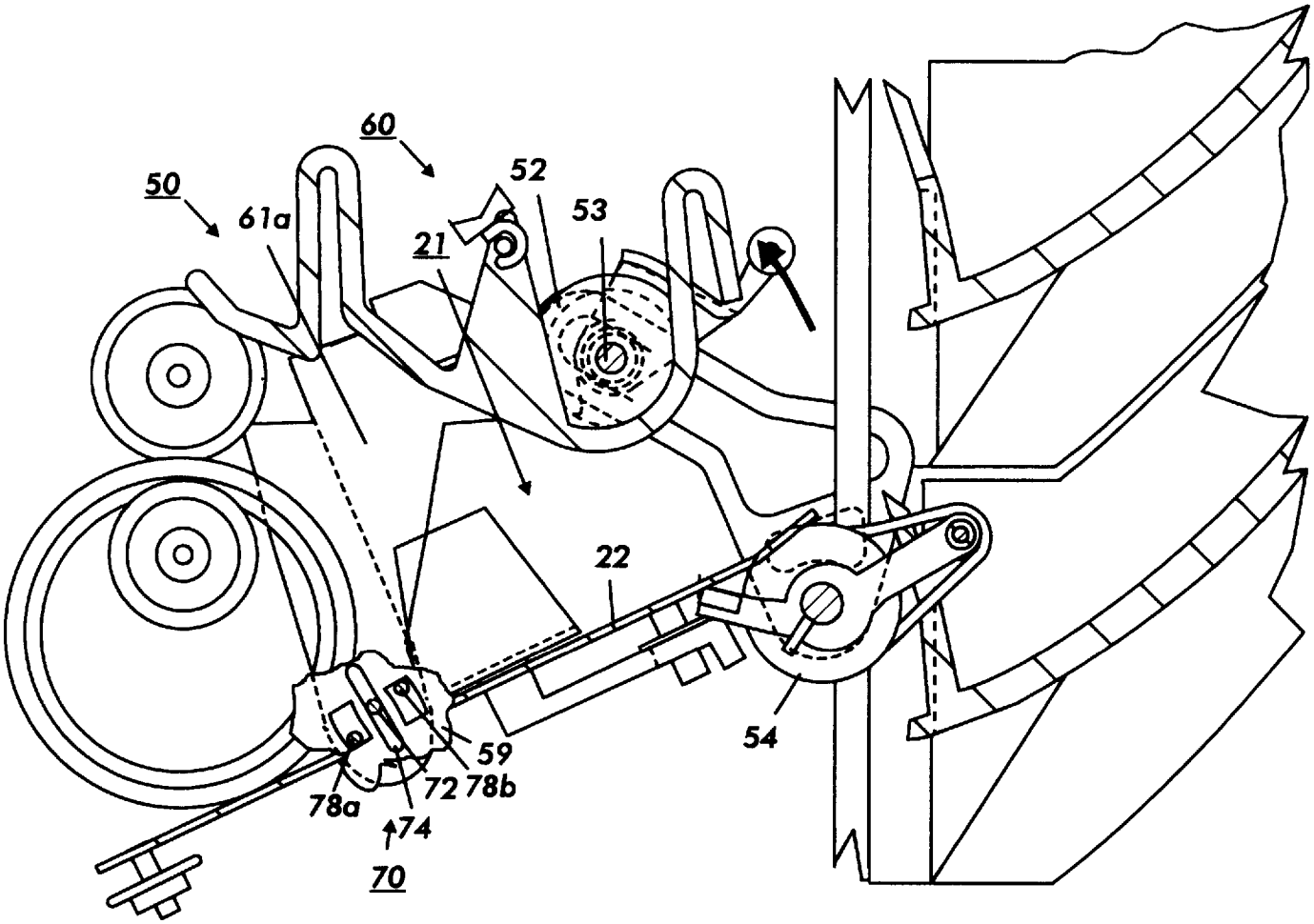
Figure 5:
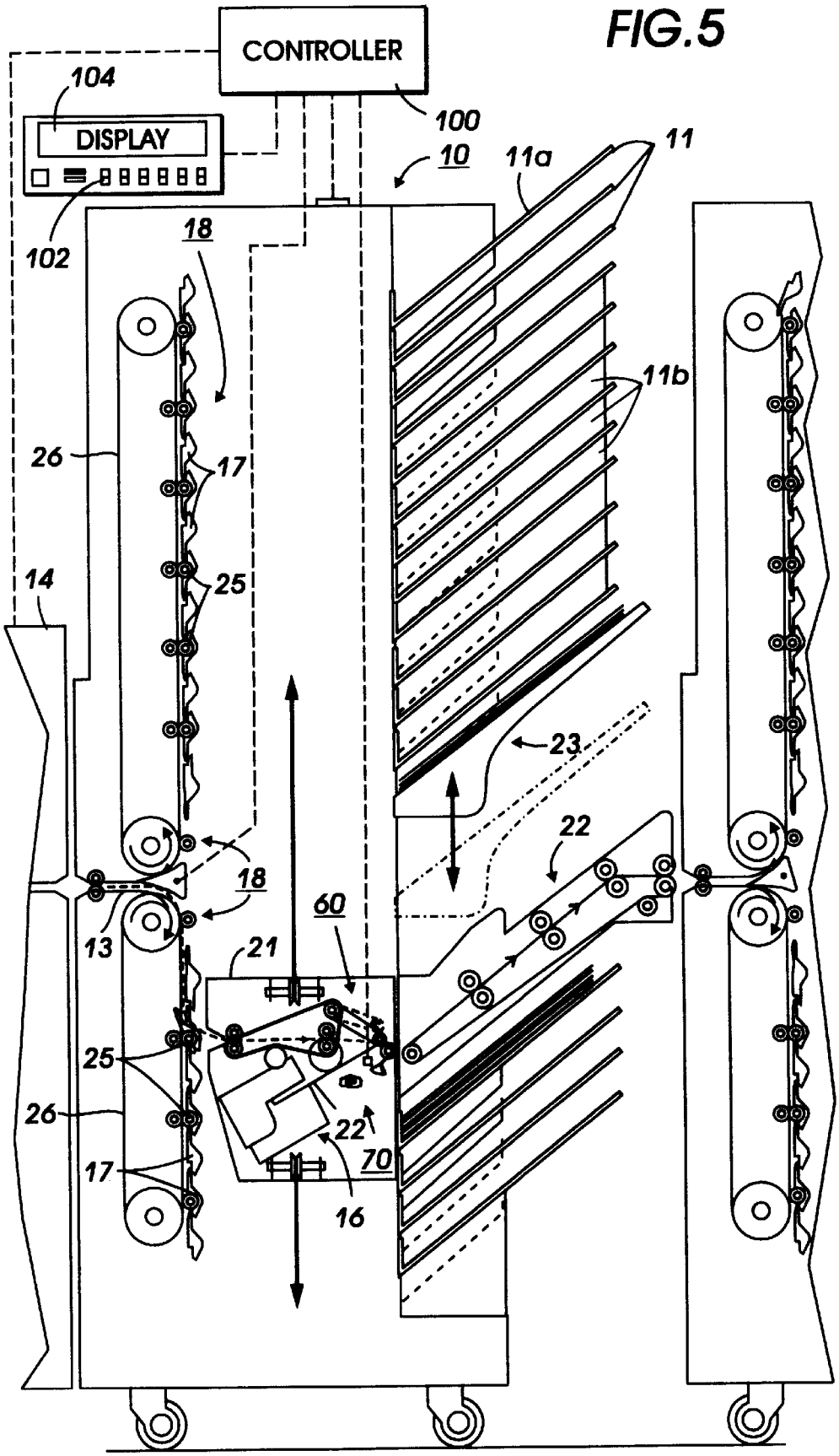

Various of the above-mentioned and further features and advantages will be apparent from the specific apparatus and its operation shown and described in the example below, and from the abstract and claims. Thus, the present invention will be better understood from this description of one specific embodiment, including the drawing figures (approximately to scale) wherein:

FIGS. 1, 3 and 4 are similar enlarged partial plan views of an exemplary improved sheet output system, in an exemplary sheets compiler unit for a printer mailbox system as in the above-cited application, in accordance with the present invention, shown in a first or sheet ejection position in FIG. 1 and in a second or raised position in FIG. 4, and with all but the related portion of the mounting frame broken away as shown for clarity;

FIGS. 2A and 2B show further simplified partial views of the system of FIGS. 1, 3 and 4 with the said position shown in phantom lines and said second position shown in solid lines, with FIG. 2A being further enlarged and showing only the pivotal mounting area and the sheet feeding wheels;

and FIG. 5 is a partially schematic frontal view of an exemplary mailbox system as one example of the possible application of said exemplary improved sheet output system.

As noted above, while the embodiment of the Figures is for a mailboxing system with a moving compiler/finishing system moving vertically between selected fixed mailbox bins into which sheets or compiled sets of sheets are selectively placed, this is merely exemplary of the various versions, alternatives and applications of the present invention, which will vary depending upon the particular application and its sheet output system.

Referring first to FIG. 5 by way of background, there is shown one example of a prior art mailboxing system, further described in the above-cited references, as noted. In the mailbox unit 10 of FIG. 5 a vertically repositionable compiler and finishing unit 21 is movable vertically adjacent to selected bins 11 of a vertical array of such bins. Some or all of the bins 11 may be normally locked but electronically unlockable bins 11*b*, or an open top level general use tray 11*a*, or replaced by a high capacity elevator stacking tray 23, or a bypass transport 22 connecting to another downstream mailbox unit 10. This may all be under the control of a programmable controller 100 with an associated keypad entry system 102 and display 104. This mailbox unit 10 is sequentially fed individual printed sheets into its input path 13, from an operatively connected printer 14, to a belt transport system 26 similar to that in use in many sorters or collators, with belt engaging rollers 25 and pivotal gates 17 providing a variable position gating system 18 for selectably gating or deflecting off sheets at selectable different levels. Here, the sheets are deflected into an intermediate compiling and finishing unit 21 at different vertical positions thereof, rather than directly in a bin 11 or other output tray. It will be appreciated, however, that the unit 10 could alternatively be utilized for or operated as a sorter or collator, by feeding individual sheets sequentially from a selected pivoted gate 17 into and through the unit 21 directly out into a selected bin 11, one sheet per bin, and moving the unit 21 after each sheet has been fed into that bin. However, as described in the above-cited mailbox references, that is not the normal or desired function of this mailbox unit 10, which is normally to feed all of the sheets of an already collated printed job set into one or more bins 11 designated or assigned to a particular user, or a particular group of users. If these sheets are not to be stapled or otherwise bound in the compiler/finisher unit 21 they may be directly fed through unit 21 sequentially into a bin to be stacked therein. If, however, the sheets are to be compiled and stapled first, as by a stapler such as 16 in the unit 21, the sheets are fed into the unit 21 and compiled in the compiler tray 22 of the unit 21, and stapled therein, and thereafter the stapled job set is ejected from the compiler tray 22 into the then-adjacent bin 11 or other output, as described in the above-cited references. This imposes additional difficulties on reliable set ejection from the compiler tray, since the compiled job set can vary considerably in the number of its sheets, the thickness, weight or size of the set, and the set engagement area by the ejection system. As also noted in the cited art, particularly for longer sheets, downstream portions of sheets being compiled in compiler tray 22 may extend into and be partially supported by the adjacent bin 11.

This feeding of sheets from the unit 21 to eject for stacking with improved feeding and control may be provided as shown in the embodiment of the other Figures here, which as noted may be incorporated into the mailbox system of FIG. 5, or many other sheet output systems. Also disclosed in these other Figures is a pivotally extendible sheet ejection nip system, which is described in the above-cited application thereon and need not be redescribed herein.

Referring now to the exemplary improved sheet ejection system 50 shown here, plural driven elastomeric sheet drive rollers 52 axially spaced along a driven drive shaft 53 are lowered into a first position down onto the sheets in the compiler tray 22 in the compiler/finisher unit 21 to eject them after compiling and finishing. That is, when the shaft 53 with rollers 52 is lowered, as in FIG. 1 or as in phantom in FIG. 2, rollers 52 engage the top sheet, and between it and underlying idler pulleys 54 forms a sheet feeding nips drive for the compiled sheet set to be ejected. The idlers 54 here are mounted on a fixed axis below the plane of the compiler tray 22, and it is desired that they not have to be driven, and that the upper rollers 52 be driven instead, so that their drive can be shared with the drive of other driven components of the compiler unit 21, as schematically illustrated in FIG. 5. To that end, control of the alignment and position of the shaft 53 is important, yet it is also desirable to provide for some degree of freedom of relative vertical movement (transverse tilting) of the shaft 53 to ensure even nip forces between the respective rollers 52 and their respective idlers 54 along the axis of drive shaft 53 irrespective of mechanical variations and differences in sheet set thickness, etc.

Said nip force for set ejection may be desirably increased by a normal force spring 55 push down on the shaft 53 in this first or set ejection position. Desirably, this is only a single spring 55, centrally engaging drive shaft 53.

To remove the sheet ejection system 50 out of the way for unobstructed sheet compiling, etc., it is pivotally lifted out of said first or set ejection position into a second, raised, position with a pivotal mounting system 60. That may desirably include a single lifting system 62 engaging the drive shaft 53 to lift the drive shaft into said second position. The pivotal mounting system 60 here maintains the drive shaft in a properly defined position in said second position, as will be further described.

Here, the opposite (front and rear) end portions of drive shaft 53 are rotatably mounted to outer end portions of two respective lever arms 61*a* and 61*b* mounted on opposite (front and rear) sides of the compiler tray 22 to form part of the pivotal mounting system 60 for the shaft 53. The inner or upstream ends of the lever arms 61 are pivotally mounted to areas of the machine frame with a special mounting arrangement for one or both lever arms 61 as will be described now in more detail, and as shown in detail in the drawings.

There is shown a pivotal mounting arrangement 70 which provides a limited degree of freedom of movement or floating of at least one end of the axial drive shaft 53 on an axis of movement perpendicular to that shaft when the pivotal mounting system 60 has pivoted the drive shaft into said first position for engaging sheets in the compiling tray for sheets ejection, to provide a self-leveling and more uniform sheet engagement force of the plural sheet drive rollers 52 along the drive shaft 53. Yet, this same pivotal mounting arrangement 70 also further provides a positive constrained engagement of the drive shaft 53 position by the pivotal mounting system 60 when the pivotal mounting system pivots the drive shaft 53 into its raised or second position, to provide a more accurately centered position of this shaft by the pivotal mounting system in the second position.

In this pivotal mounting arrangement 70 at least one side of the pivotal mounting system 60 is pivotally mounted to an area of the supporting frame 59 with a pivot pin 72 extending from that lever arm 61. The supporting frame 59 connecting area has an elongated mounting slot 74 for mounting and laterally constraining this pivot pin 72 therein, but also providing for vertical movement of the pivot pin 72 therein, so as to allow that side of the pivotal mounting system 60 (that lever arm 61) to move vertically relative to the supporting frame 59 in the first position of the pivotal mounting system 60, as shown in FIGS. 1 and 3 and in phantom in FIG. 2 (the other arm 61 (61*b*) is hidden).

However, as shown enlarged in FIG. 2A, the same supporting frame 59 area also has at least one, and preferably two, adjacent but limited length slots 76*a* and 76*b*, each providing an end stop 77*a* and 77*b*. These limited length slots 76*a* and 76*b* are spaced on opposite sides from the pivot mounting slot 74. Mating therewith are mounting mounting pins 78*a* and 78*b* spaced from pivot pin 72 but also extending from said lever arm 61, each engaged within their respective limited length slot 76*a* and 76*b*. These mounting pins 78*a* and 78*b* are vertically movable within their limited length slots 76*a* and 76*b* in the first position of the pivotal mounting system 60, so as not to substantially restrict movement of pivot pin 72 in mounting slot 74 in said first position. However, these mounting pins 78*a* and 78*b* engage their respective opposing end stops 77*a* and 77*b* in the second or raised position of said pivotal mounting system 60, as shown in FIGS. 2 and 4, to thereby align and constrain the position of the pivot pin 72 centrally in the mounting slot 74, to insure an accurately centered position of said drive shaft by said pivotal mounting system 60 in said second position.

There are other specific mechanisms which can be used to achieve the above-described movements and functions. While the embodiment disclosed herein is generally preferred, it will be appreciated from this teaching that various alternatives, modifications, variations or improvements therein may be made by those skilled in the art, which are intended to be encompassed by the following claims:

What is claimed is:

1. In a sheet handling system including a supporting frame, a sheets compiling tray and a sheets ejection system, said sheets ejection system including an axial drive shaft with plural sheet drive rollers and a pivotal mounting system to which said drive shaft is mounted, said pivotal mounting system providing pivoting of said drive shaft with said plural sheet drive rollers between a first position for engaging sheets in said sheets compiling tray for sheets ejection and a second position out of engagement with said sheets in said sheets compiling tray; the improvement wherein:

said pivotal mounting system provides a limited degree of freedom of movement of at least one end of said axial drive shaft on an axis of movement perpendicular to said axial drive shaft when said pivotal mounting system has pivoted said drive shaft into said first position for engaging sheets in said sheets compiling tray for sheets ejection, to provide a self-leveling more uniform sheet engagement force of said plural sheet drive rollers along said drive shaft;

said pivotal mounting system further providing a positive constrained engagement of said drive shaft by said pivotal mounting system when said pivotal mounting system is pivoting said drive shaft into said second position to provide a more accurately centered position of said shaft by said pivotal mounting system in said second position;

wherein at least one side of said pivotal mounting system is pivotally mounted to said supporting frame with a pivot pin, and said supporting frame has a mounting slot for mounting and laterally constraining said pivot pin in said mounting slot but providing for vertical movement of said pivot pin therein to allow said one side of said pivotal mounting system to move vertically relative to said supporting frame, and wherein said supporting frame also has at least one limited length slot providing an end stop, which limited length slot is spaced from said mounting slot, and wherein said pivotal mounting system has at least one mounting pin engaged within said limited length slot, which mounting pin is vertically movable within said limited length slot in said first position of said pivotal mounting system, but which mounting pin engages said end stop of said limited length slot in said second position of said pivotal mounting system to constrain the position of said pivot pin in said mounting slot to insure an accurately centered position of said drive shaft by said pivotal mounting system in said second position; and wherein said supporting frame has at a second limited length slot providing a second end stop, which limited length slot is spaced from the opposite side of said mounting slot, and wherein said pivotal mounting system has a second mounting pin engaged within said second limited length slot, which second mounting pin is vertically movable within said second limited length slot in said first position of said pivotal mounting system, but which second mounting pin engages said second end stop of said second limited length slot in said second position of said pivotal mounting system to center the position of said pivot pin in said mounting slot to insure an accurately centered position of said drive shaft by said pivotal mounting system in said second position.

2. The sheet handling system of claim 1, wherein said pivotal mounting system includes a single lifting system engaging said drive shaft to lift said drive shaft into said second position which is dependent on said pivotal mounting system to maintain both ends of said drive shaft in a defined position in said second position.

3. The sheet handling system of claim 1, further including a normal force spring centrally engaging said drive shaft in said first position.

4. The sheet handling system of claim 1, further including plural fixed axis idler rollers mounted to oppose said plural sheet drive rollers when said drive shaft is in said first position.

5. The sheet handling system of claim 1, wherein said drive shaft is rotatably mounted with a fixed position axis of rotation relative to said pivotal mounting system.

6. The sheet handling system of claim 1, wherein said pivotal mounting system comprises a pair of pivotal mounting arms pivotally mounted on opposite sides of said sheets compiling tray for mounting opposite ends of said drive shaft.

7. The sheet handling system of claim 6, wherein one of said pivotal mounting arms is mounted to said supporting frame with a fixed axis of rotation, and the other of said mounting arms is mounted to said supporting frame about an axis of rotation which is variable in said first position and fixed in said second position.

* * * * *